United States Patent [19]

Ayers

[11] Patent Number: 4,500,151

[45] Date of Patent: Feb. 19, 1985

[54] MARINE ELECTRICAL PLUG

[75] Inventor: Ray R. Ayers, Houston, Tex.

[73] Assignee: Shell Oil Company, Houston, Tex.

[21] Appl. No.: 443,000

[22] Filed: Nov. 19, 1982

[51] Int. Cl.[3] ..... H01R 11/00

[52] U.S. Cl. ..... 339/59 R; 174/77 R; 339/94 M; 339/218 R

[58] Field of Search ..... 174/77 R, 93; 339/60, 339/94, 103 M, 117 R, 218 R, 218 C, 221 R, 59 R, 59 M

[56] References Cited

U.S. PATENT DOCUMENTS

| | | | |
|---|---|---|---|
| 2,700,140 | 1/1955 | Phillips | 339/94 M |
| 3,054,847 | 9/1962 | Colbert | 174/93 |
| 3,096,134 | 7/1963 | Kanarek | 339/150 |
| 3,113,999 | 12/1963 | Heikkinen | 174/151 |
| 3,124,405 | 3/1964 | Massa | 339/60 |
| 3,158,420 | 11/1964 | Olson et al. | 339/96 |
| 3,241,095 | 3/1966 | Phillips | 339/94 M |
| 3,278,885 | 10/1966 | Klinger | 339/60 |
| 3,324,449 | 6/1967 | McLoad | 339/117 |
| 3,339,632 | 9/1967 | Lewis | 166/0.6 |
| 3,410,950 | 11/1968 | Freudenberg | 174/84 |
| 3,430,187 | 2/1969 | DeMan et al. | 339/103 |
| 3,432,612 | 3/1969 | Spiegel et al. | 174/88 |
| 3,487,353 | 12/1969 | Massa | 339/89 |
| 3,489,987 | 1/1970 | Niskin | 339/49 |
| 3,522,576 | 8/1970 | Cairns | 339/91 |
| 3,537,062 | 10/1970 | Niskin | 339/60 |
| 3,546,657 | 12/1970 | Cook | 339/60 |
| 3,665,368 | 5/1972 | Ellis | 339/60 R |
| 3,705,950 | 12/1972 | Jirka et al. | 174/77 R |
| 3,725,846 | 4/1973 | Strain | 339/61 R |
| 3,725,852 | 4/1973 | Blanchet | 339/198 V |
| 3,729,699 | 4/1973 | Briggs et al. | 339/42 |
| 3,784,959 | 1/1974 | Horton | 339/60 M |
| 3,816,641 | 6/1974 | Iversen | 174/76 |
| 3,821,690 | 6/1974 | Small | 339/75 R |
| 4,135,054 | 1/1979 | Vloedman | 174/77 R |
| 4,291,932 | 9/1981 | Cox | 339/60 R |
| 4,332,975 | 6/1982 | Dienes | 174/77 R |

OTHER PUBLICATIONS

KINTEC, Incorporated, (FITA), LP-Series (CP) Field Installable and Testable Assembly, FIGS. 1 and 2.

*Primary Examiner*—John McQuade
*Assistant Examiner*—Paula Austin

[57] ABSTRACT

An end terminal is provided for an underwater electrical cable and has a booted seal and a foam-filled area between the seal and the outer structural boot.

9 Claims, 1 Drawing Figure

MARINE ELECTRICAL PLUG

BACKGROUND OF THE INVENTION

Underwater electrical cables cause major problems when they begin to leak. One of the greatest sources of leakage is in the end terminations, or "plugs". The primary water sealing means in an underwater cable should be the insulation encapsulating the strands of the individual conductors. Oftentimes the art considers the outer jacket of the bundle of conductors to be the primary sealing means, but it is actually a secondary sealing means. The major problem is that it is difficult to effect a seal between the insulating material and the plug. One of the best insulating materials for the conductors is an ethylenepropylene copolymer which does not readily bond to other sealing materials. Even commonly used epoxy pottings do not readily bond to it. One good solution to this sealing problem is to use a rubber "boot" which seals along the outside of the multiple insulated conductors and the plug body containing solder pins. Silicone grease is applied to the boot cavity after soldering the conductors to the pins, effectively sealing the area from water intrusion. In this connection, reference may be had to the field installable and testable connectors of KINTEC, Inc. Such connectors work well, but are bulky, stiff, heavy and expensive. Additionally, such connectors work best for deep subsea application where the best seals are hydrostatically pressure energized. Other smaller and more flexible plugs which do not use such a boot for sealing, instead use an epoxy potting material to seal the joint. The problem with this plug is that epoxies tend to contract upon curing, leaving a channel for water to seep in, particularly if the connection is subject to cyclic flexing.

In marine seismic exploration operations, underwater electrical plugs are needed to connect power and instrumentation conductors to air guns. These guns are used as a source to obtain acoustic reflections from the seafloor. Typically, these guns are fired every 10 to 15 seconds and the impulsive pressure waves produced are quite strong. Electrical "jumper" cables used for this application must withstand a great deal of structural abuse, and normally they do not last long before developing leaks. The first-mentioned booted plug is too stiff and massive to have reasonable structural integrity to withstand such cyclic impulsive loadings. Typically, structural elements exposed to such blast elements will not last long if they are not flexible. Further, the pressure waves produced by the guns have negative (vacuum) parts, making the boots "pump". There is consequently a greater possibility that water will intrude the boot during fluctuating pressure than during static hydrostatic pressure.

Accordingly, it is the primary purpose of the invention disclosed hereinafter to provide an end terminal for an underwater electrical cable which solves these problems and which can be utilized in marine seismic operations as underwater electrical plugs which are needed to connect power and instrumentation conductors to air guns. Another purpose of the present invention is to improve the inner boot sealing capability of the end terminal, to make the connection more flexible, and to attenuate pressure loadings on the insulated conductors.

Other purposes, advantages and features of the invention will be apparent to one skilled in the art upon reviewing the following disclosure.

Applicant is not aware of any prior art references which, in his judgment as one skilled in the art of marine seismic underwater electrical plugs, would anticipate or render obvious the novel end terminal of the instant invention; however, for the purposes of fully developing the background of the invention and establishing the state of the requisite art, the following references are set forth: two diagrams of plugs available from KINTEC, Inc., 9540 Cozycroft Avenue, Chatsworth, Calif. 91311, showing respectively, FITA and MLD LP series CR plugs; U.S. Pat. Nos. 3,096,134; 3,113,999; 3,124,405; 3,158,420; 3,278,885; 3,324,449; 3,339,632; 3,410,950; 3,430,187; 3,432,612; 3,487,353; 3,489,987; 3,522,576; 3,537,062; 3,546,657; 3,665,368; 3,821,690; 3,725,846; 3,725,852; 3,729,699; 3,816,641; and 3,784,959.

SUMMARY OF THE INVENTION

Figure 1:
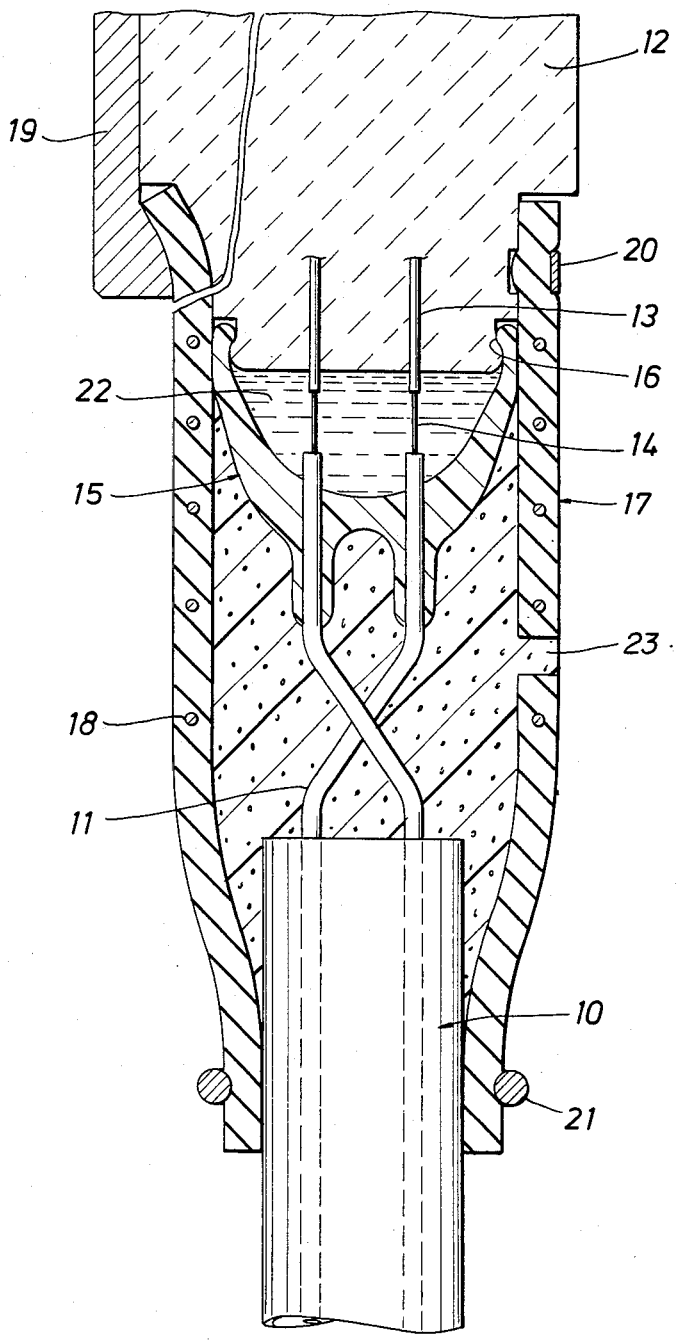
FIG. 1 provides a cross sectional view of the end terminal of the present invention.

The present invention provides an end plug, male or female, for an underwater electrical cable, which plug includes an electrical contact insert; at least one conductive pin extending from said inserts; at least one insulated conductor extending from said electrical cable and into conductive contact with said conductive pin; a non-conductive material disposed surrounding the locale of said conductive contact of said conductive pin and said insulated conductor; a seal boot at least partially surrounding said non-conductive material; a polymeric foam at least partially surrounding said seal boot; and an outer boot at least partially surrounding said polymeric foam. The polymeric foam is preferably of one piece, being formed in-situ, and is closed-cell and flexible.

DESCRIPTION OF PREFERRED EMBODIMENTS

In accordance with the present invention, an end plug for an underwater electrical cable is provided which uses a booted seal and a foam-filled area between that seal and an outer structural boot. Such a plug is shown in FIG. 1. The key feature of this design is the foam-filled annulus between the outer and the inner boots. The foam is preferably closed-cell and flexible. The plug is preferably used in marine seismic exploration operations which are needed to connect power and instrumentation conductors to air guns, and as such serve to attenuate the incoming blast pressure wave, reducing the loading on the conductors. This foam, in expanding, tends to preload the conductor sleeves of the inner boot against the insulated conductors as well as press outward against an outer structural boot. The effects of the foam used in this way are to improve the inner boot sealing capability, make the connection more flexible, attenuate pressure loadings on the insulated conductors, and in addition make the plug reasonably inexpensive to fabricate.

Referring specifically to FIG. 1, there is provided a more specific disclosure of the invention wherein there is shown an electrical cable 10 which includes an outer jacket and insulated conductors 11. At the other end of the end terminal of the present invention there is an electrical contact insert 12 from which extends pins 13 having a pointed end 14 which connects with insulated conductors 11. The electrical connection between pins 13 and conductors 11 may be made by soldering, etc. A seal boot 15 serves not only to center and align the conductors 11 but also functions to partially encapsulate the locale wherein conductive contact is made between the conductive pins 13 and the insulated conductors 11. A non-conductive material 22 such as silicone grease or other viscous, non-conductive fluid is disposed surrounding this area of contact and is backed up on one side by insert 12. The seal boot 15 fits into a recess 16 of the insert 12 and is held in place by an outer structural boot 17 which fits about the lip of the seal boot 15 and secures it to the insert 12. The outer structural boot 17 may be reinforced with steel rings 18, if required, and is preferably of rubber or the like as is the seal boot 15. A steel clamp 20 can be utilized to attach the outer boot 17 to the insert 12. An alternate clamp assembly is shown at the upper left hand side of FIG. 1 and a plug boot 19 is provided to hold the outer boot 17 clamped to the insert 12. The opposite end of outer boot 17 is attached to electrical cable 10 by means of a steel clamp 21. A foam is injected through an opening 23 of boot 17 and into a space which surrounds seal boot 15 and the exposed part of insulated conductor 11. Preferably, the foam is a closed cell flexible foam such as polyurethane.

The foregoing description of the invention is merely intended to be explanatory thereof. Various changes in the details of the described plug may be made within the scope of the appended claims without departing from the spirit of the invention.

What is claimed is:

1. A plug, male or female, for an underwater electrical cable comprising:

an electrical contact insert;

at least one conductive pin extending from said electrical contact insert;

at least one insulated conductor extending from said electrical cable and into conductive contact with said conductive pin;

a non-conductive material disposed surrounding the locale of said conductive contact of said conductive pin and said insulated conductor;

a seal boot forming a cup partially surrounding the non-conductive material, with the electrical contact insert being on the opposite side of the non-conductive material from the seal boot;

a polymeric foam at least partially surrounding said seal boot; and an outer boot at least partially surrounding said polymeric foam, a rim of the seal boot being secured between a recess in the electrical contact insert and the outer boot.

2. The plug of claim 1 wherein the seal boot positions the insulated conductors in a central, axially aligned location.

3. The plug of claim 1 wherein the seal boot and outer boot are rubber, the non-conductive material is silicone grease, and the polymeric foam is closed-cell and flexible.

4. The plug of claim 1 wherein the polymeric foam is one integral piece.

5. The plug of claim 4 wherein the polymeric foam is formed in situ.

6. The plug of claim 1 wherein the polymeric foam is formed in situ.

7. The plug of claim 6 wherein the outer boot is clamped to a recess in the insert.

8. The plug of claim 6 wherein the outer boot is clamped between a recess in the insert and a plug boot.

9. A plug, male or female, for an underwater electrical cable comprising:

an electrical contact insert;

at least one conductive pin extending from said electrical contact insert;

at least one insulated conductor extending from said electrical cable and into conductive contact with said conductive pin;

a non-conductive material disposed surrounding the locale of said conductive contact of said conductive pin and said insulated conductor;

a seal boot forming a cup partially surrounding the non-conductive material, with the electrical contact insert being on the opposite side of the non-conductive material from the seal boot;

a polymeric foam at least partially surrounding said seal boot; and an outer boot at least partially surrounding said polymeric foam, a rim of the seal boot being secured between the electrical contact insert and the outer boot.

* * * * *